United States Patent [19]

McDaniel

[11] Patent Number: 4,685,520

[45] Date of Patent: Aug. 11, 1987

[54] OPEN HOLE PIPE RECOVERY CIRCULATION VALVE

[76] Inventor: Robert J. McDaniel, 711 Church St., Columbia, Miss. 39429

[21] Appl. No.: 766,093

[22] Filed: Aug. 14, 1985

[51] Int. Cl.[4] ..... E21B 31/03

[52] U.S. Cl. ..... 166/332; 166/301

[58] Field of Search ..... 166/319, 320, 321, 323, 166/324, 332, 98, 99, 100, 51, 278, 301; 175/371

[56] References Cited

U.S. PATENT DOCUMENTS

| | | | |
|---|---|---|---|
| 3,777,813 | 12/1973 | Dendy et al. | 166/322 |
| 3,827,501 | 8/1974 | Johnson et al. | 166/321 |
| 4,162,691 | 7/1979 | Perkins | 166/323 |
| 4,361,193 | 11/1982 | Gravley | 166/223 |
| 4,386,667 | 6/1983 | Millsapps, Jr. | 175/371 |
| 4,434,854 | 3/1984 | Vann et al. | 166/323 |
| 4,566,478 | 1/1986 | Deaton | 166/323 |

*Primary Examiner*—Stephen J. Novosad
*Assistant Examiner*—Terry Lee Melius
*Attorney, Agent, or Firm*—Pravel, Gambrell, Hewitt, Kimball & Krieger

[57] ABSTRACT

A pipe recovery circulation valve for open hole drilling, which includes a valve body attachable intermediate sections of drill string for normally allowing flow therethrough to the drill bit. The valve further includes a fluid flow means where upon activation directs fluid flow exterior to the valve body, a first main sleeve slideable within the bore of the valve body moveable between a first position wherein the fluid flow means prevents fluid flow exterior to the valve body; and a second position wherein the fluid flow means is activated to allow flow exterior to the valve body. An upper retainer sleeve is fixed within the valve body, which includes a spring for allowing the main sleeve to move between the first and second positions against the bias of the spring. A spring loaded detent pin is provided for maintaining a main sleeve in the second position for allowing fluid flow exterior to the valve body. An unlocking sleeve, slideable within the valve body cooperates with an arm member to disengage the detent pin for allowing the main sleeve to shift into the first position for preventing fluid flow exterior to the valve body. The main sleeve and unlocking sleeve are activated by a wireline tool lowered within the tool during operation. There is further provided a guard sleeve contained within the lower portion of the valve body for guarding functioning of the fluid flow means during operation.

8 Claims, 10 Drawing Figures

OPEN HOLE PIPE RECOVERY CIRCULATION VALVE

BACKGROUND OF THE INVENTION

1. Field of the Invention

The apparatus of the present invention relates to downhole tools. More particularly, the present invention relates to a pipe recovery circulation valve spaced intermittently along a drill string in an open hole for providing circulation around a particular segment of the drill string, when a portion of the drill string is lodged in the hole.

2. General Background

In drilling of oil and gas wells, the first portion of the well drilled into the earth is lined with a continuous column of pipe called "casting". This casing would protect the walls of the borehole from collapsing during the drilling process. However, as the borehole is continued down to deeper depths, the casing is no longer utilized and the drill bit is bored into what is referred to as an "open hole"; that is a hole wherein the walls of the borehole are the substrat around the bit and drill string.

In that event, often times for example in the drilling of deviated hole, where one must turn the angle of the drill bit away from the vertical, the drill string will, as it rotates in the borehole, cut a groove into the wall of the borehole and form a "key seat" which becomes a resituated borehole in the drilling. Often times, this would result in a drill string becoming stuck at that point, and it would be unable to circulate. In the event one should attempt to retrieve the drill string by pulling it out of the hole, the string would either stretch or perhaps in the worse case, break or uncouple, and therefore would have to be fished from the hole if possible.

Therefore, it would be beneficial to provide a means along the drill string which would help to dislodge that particular portion of the string from a key seat or collapsed wall of the borehole, and thus retrieve the string without the loss of expensive pipe or rig time.

Several patents have been obtained in the subject matter of downhole circulation tools of the like, the most pertinent as provided in the prior art statement which is being submitted herewith.

SUMMARY OF THE PRESENT INVENTION

The apparatus of the present invention solves the problems confronted in the art in a simple and straight forward manner. What is provided is a pipe recovery circulation valve for open hole drilling, which includes a valve body attachable intermediate sections of drill string for normally allowing flow therethrough to the drill bit. The valve further includes a fluid flow means where upon activation directs fluid flow exterior to the valve body, a first main sleeve slideable within the bore of the valve body moveable between a first position wherein the fluid flow means prevents fluid flow exterior to the valve body; and a second position wherein the fluid flow means is activated to allow flow exterior to the valve body. An upper retainer sleeve is fixed within the valve body, which includes a spring for allowing the main sleeve to move between the first and second positions against the bias of the spring. A spring loaded detent pin is provided for maintaining a main sleeve in the second position for allowing fluid flow exterior to the valve body. An unlocking sleeve, slideable within the valve body cooperates with an arm member to disengage the detent pin for allowing the main sleeve to shift into the first position for preventing fluid flow exterior to the valve body. The main sleeve and unlocking sleeve are activated by a wireline tool lowered within the tool during operation. There is further provided a guard sleeve contained within the lower portion of the valve body for guarding functioning of the fluid flow means during operation.

Therefore, it is an object of the present invention to provide a pipe recovery circulation valve for use in open hole drilling which can be located intermittently along the length of the drill string;

It is still a further principal object of the present invention to provide a circulation valve which can be made operable or inoperable from the drilling platform without having to retrieve the valve;

It is still a further object of the present invention to provide circulation valve which would allow drilling fluid to flow between a portion of the drill string and the borehole for lubricating the borehole and releasing that portion of the drill string jammed or stuck in the hole.

BRIEF DESCRIPTION OF THE DRAWINGS

For a further understanding of the nature and objects of the present invention, reference should be had to the following detailed description, taken in conjunction with the accompanying drawing in which the parts are given like reference numerals and wherein.

DETAILED DESCRIPTION OF THE PREFERRED EMBODIMENT

Figure 1:
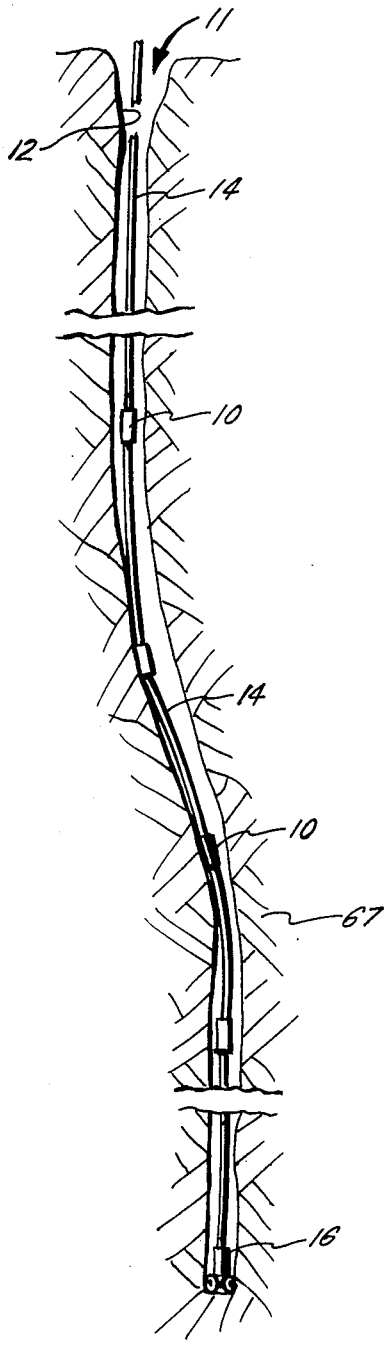
FIG. 1 is an overall view of the preferred embodiment of the apparatus situated intermittently along the drill string downhole.

FIGS. 1 through 8 illustrate the preferred embodiment of the pipe open hole recovery circulation valve by the numeral 10. Initially, FIG. 1 illustrates circulation valve 10 situated down a borehole 11, which is an open borehole, i.e., having side walls 12 open to the circulating drill string. As seen in the FIGURE, circulation valve 10 is situated between sections of drill string 14 and in the preferred embodiment would be placed initially directly above drill collars 16 and at 500 foot intervals thereafter.

Turning now to the structure of the apparatus, reference is made to FIGS. 2 through 8. As seen in the FIGURES circulation valve 10 would comprise a valve body portion 20 having a continuous annular wall portion 22, and defining a continuous fluid flow bore 23 therein for allowing fluid flow therethrough and in the direction of arrows 24. As seen in the FIGURES, body 20 would have a threaded male pin portion 26 on its lower end for threadably attachment to a section of drill string, and a female box portion 28 for threadably attaching to a upper portion of drill string. In the preferred embodiment, the diameter of the valve body 20 would be of equal diameter to a segment of drill pipe as situated therebetween.

Structurally, circulation valve 10 would include a series of functional collar members for operating in conjunction with the valving function of the valve. For purposes of explanation, reference shall be had to the structural components followed by a functional analysis of the inter-relationship of the components contained therein. As seen in the FIGURES, in particular FIGS. 2 through 8 there is first provided an upper retainer sleeve 30 situated within the upper portion of valve body 20 having an upper retainer ring 31 resting upon a shoulder 32 of valve body 20, with the sleeve body portion 34 extending down into flow bore 23, having an annular space 35 between the wall of sleeve 34 and the inner wall 36 of valve body 20. Annular space 35, as seen in the FIGURES would house coil spring 38, the upper portion of spring 38 seated against the lower face of upper retainer sleeve 30.

Figure 2:
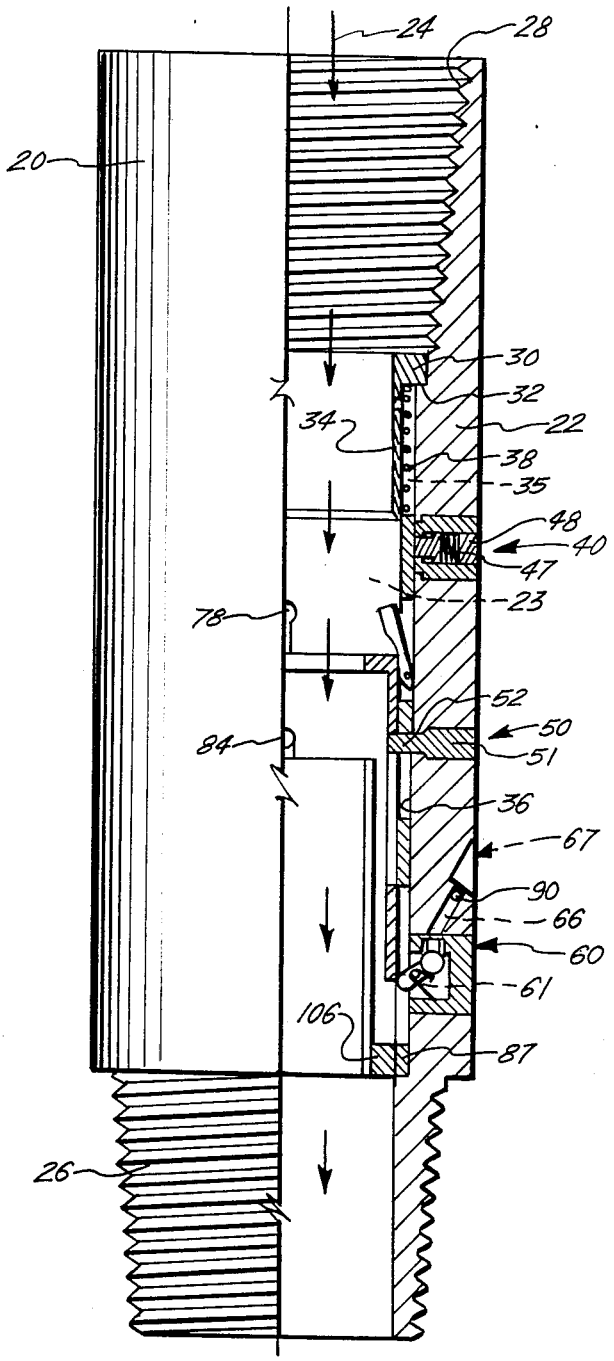
FIG. 2 is a one-quarter cutaway view of the preferred embodiment of the apparatus of the present invention in the normally closed position.

Turning now to structural components within the wall of valve body portion 20, reference is made to locking means 40. Locking means 40 comprises a detent housing 41 having a bore 45 therethrough in communication with the interior of flow bore 23. Housed within detent housing 41 is detent pin 42 moveable between a first position wherein the entire pin is situated within bore 45 and a second position wherein the end portion 46 of detent pin 42 extrudes out into flow bore 23. There is further provided within bore 45 spring member 44 situated between the inner face 47 of detent pin 42 and a stop portion 48 so that detent pin 42 moves against the bias of spring 44 when pin 42 is in the first position as seen in FIG. 2. The function of locking means 40 will be described further.

Figure 3:
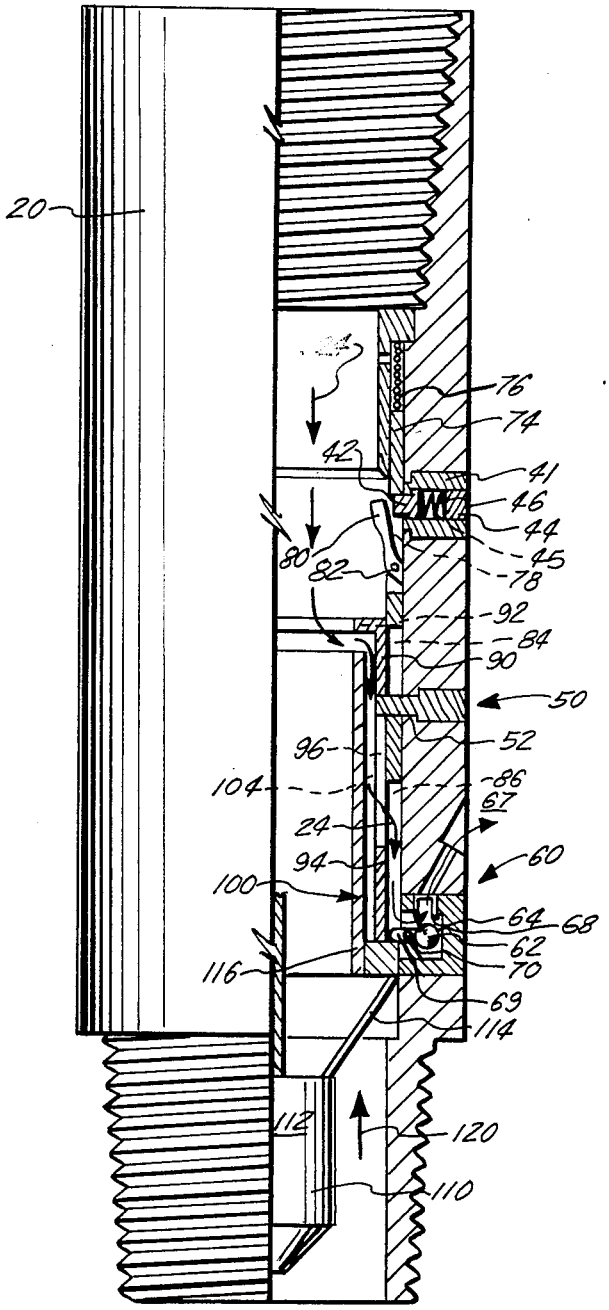
FIG. 3 is a one-quarter cutaway view of the preferred embodiment of the apparatus of the present invention in the open position.

Further, as seen in the FIGURES body portion 20 includes a stop pin and guide means 50 which comprises a pin body 51 disposed within the wall portion 22 of valve body 20 with a portion 52 extruding out into flow bore 23. As opposed to detent pin 42, stop pin and guide means 50 is unable to shift and is permanently situated in the extruding position as seen in FIGS. 2 and 3.

As seen further in the FIGURES, there is provided a fluid circulation valve means 60 contained within the wall of body portion 20. Valve means 60 comprise a rotatable ball valve 62 moveable within valve chamber 61, valve chamber 61 being in fluid communication with principal fluid flow bore 23 and fluid passageway 66 which allows fluid flow exterior to the valve at port 67. Ball valve 62 further provides a sealing face 68 which seals against valve seat 64 when the ball valve is in a first position as seen in FIG. 2, and rotates to a non-sealing position as seen in FIG. 3. Ball valve 62 further comprises a lower arm portion 69 which, functions to rotate the valve between sealing and non-sealing positions. There is further provided a flexible spring member 70 which would normally contain valve 62 in the closed sealing position as seen in FIG. 2.

Turning now to the various structures of the sleeve portions situated directly adjacent the upper retainer sleeve 30 is main sleeve 72. In the preferred embodiment, the outer diameter of main sleeve 72 is substantially equal to the diameter of flow bore 23, therefore main sleeve 72 slidingly mates against the inner wall of valve 20 as seen in the FIGURES. Structurally, main sleeve 72 further comprises an annular wall portion 74 of the requisite thickness to slideably move within annular space 35 between the upper retainer sleeve body 34 and the inner wall 36 of body portion 20. As seen in the FIGURES, the upper face 76 of main sleeve 72 is in contact with the lower face of spring 38 and in the functioning of the valve 10 as will be discussed further, main sleeve 72 moves upward and downward against the bias of spring 38. Further, sleeve 72 presents a first upper slot 78 for accommodating detent pin 46, when detent pin 46 is in the second position as seen in FIG. 3. Further, slot 78 houses a moveable arm member 80 hingedly attached via pin 82 to the body of sleeve 74 and normally in the offset position as seen in FIGS. 2 and 3 while the valve is in the open and closed positions. The function of arm member 80 will be discussed further in the discussion of the functioning of the valve.

Further, main sleeve 72 provides a middle slot 84 which houses stationary stop and guide 50 as main sleeve 72 moves between up and down positions. Also, there is provided lower slot 86 for allowing fluid communication to passageway fluid flow, as indicated by arrows 24, into fluid flow passageway 66 when the valve is in the open position.

In addition to the upward and downward movement of main sleeve portion 72 in the functioning of the valve, there is further provided an inner unlocking sleeve 90 which is situated in sliding relation to the inner wall of main sleeve 72 with the top portion of unlocking sleeve 90 being substantially halfway down the bore 23. Sleeve 90 would further comprise an upper inward depending shoulder portion 92 and a sleeve body portion 94, with sleeve body portion 94 having an elongated slot 96 in alignment with lower slot 86 of the main body portion main sleeve 72 so that when unlocking sleeve 90 is in the down position fluid flow is again allowed between flow bore 23 and fluid flow passage 66.

Valve 10 further provides a third internal sleeve member which functions as a stationary guard sleeve 100 having an annular sleeve body 102 in alignment with the sleeve bodies of main sleeve 72 and unlocking sleeve 90, but with the diameter of annular guard sleeve 102 being slightly less than the inner diameter of unlocking sleeve 90, so that there is provided a fluid flow space 104 between the walls of sleeves 90 and 100 for allowing fluid flow to communicate between flow bore 23 and fluid flow passage 66. As seen in the FIGURES, sleeve body 102 on its lower portion is secured to the body 20 of valve 10 via a lower retainer ring 106, which would also serve as a means for providing movement of guard sleeve 100 during operation of the valve as will be discussed further.

So that sleeve numbers 30, 72 and 100 maintain the upright position in their movement within valve 20, there is provided a series of slots 78, 84 and 86 in the wall of valve 20 to accommodate a guide pin (not seen in the FIGURES), to assure that the sleeve members move upward and downward in a vertical position with a minimum of shifting.

OPERATION OF THE VALVE

During normal drilling, valve apparatus 10 is normally in the closed position as seen in FIG. 2. That is, fluid flow as indicated by arrows 24 through flow bore 23 flows directly down to the drill bit for its normal function. That is, in the position as seen in FIG. 2, ball valve 62 is seated against valve seat 64 under the bias of flexing spring 70, and therefore any fluid flow which may tend flow toward fluid flow passage 66 is prevented from doing so, and the principal flow is directed through bore 23 down the drill string. In the event the drill string becomes stuck at a point adjacent one of the valve members situated intermittently along the drill string, the fluid flow is shut down, and a wireline tool 110, as seen in the FIGURE, is lowered flow bore 23 to a point as seen in FIG. 3. For information purposes, wireline tool 110 would be a typical wireline tool lifting apparatus, having a main body portion 112 and a lifting arm 114, the wireline 110 placed in position via wireline 116 as seen in the FIGURES.

It should be recalled that at the point that the drill string would become stuck, the tool is in the configuration as seen in FIG. 2, i.e., fluid flow is blocked from flowing into fluid flow passage 66 by the position of ball valve 62. Therefore, wireline apparatus 110 would be lowered into position with arm 114 being baseically in the position as seen in FIG. 3. However, arm 114 would have made contact with lower retainer ring 106 of guard sleeve 100, and upon slight retrieval of wireline 110 in the direction of arrow 120, arm 114 has moved guard sleeve 100 to the position as seen in FIG. 3. In the position as seen in the FIGURE, retainer ring 106 has come into contact with lower arm portion 69 of ball valve 62 and shifted ball valve 62 to the horizontal position as seen in FIG. 3, against the bias or flexing spring 70. By doing so, the face 68 of ball valve 62 has shifted away from sealing engagement against the valve seat 64. Therefore, resuming flow of drilling fluid in the direction of arrows 24 would allow fluid flow to flow in the annular space 104 between guard sleeve 100 and unlocking sleeve 90 and through slot 86 of main sleeve 82, bypass ball valve 62 and into fluid flow passage 66 to the annular space 67 between the body 20 of the ball valve 10 and the wall 12 of borehole 11. Likewise, arm 114 has moved the main sleeve 72 in the up position, in doing so, main sleeve 72 has compressed spring 38, and has moved in upper slot 78 into position where detent pin 42 is extruding into slot 78 under the bias of spring 44, and main sleeve 72 is then unable to return into the down position due to the extruding of detent pin 42. Therefore, fluid will continue to flow out of valve 20 through fluid flow chamber 66 while the main sleeve 72 is in the up position.

Figure 4:
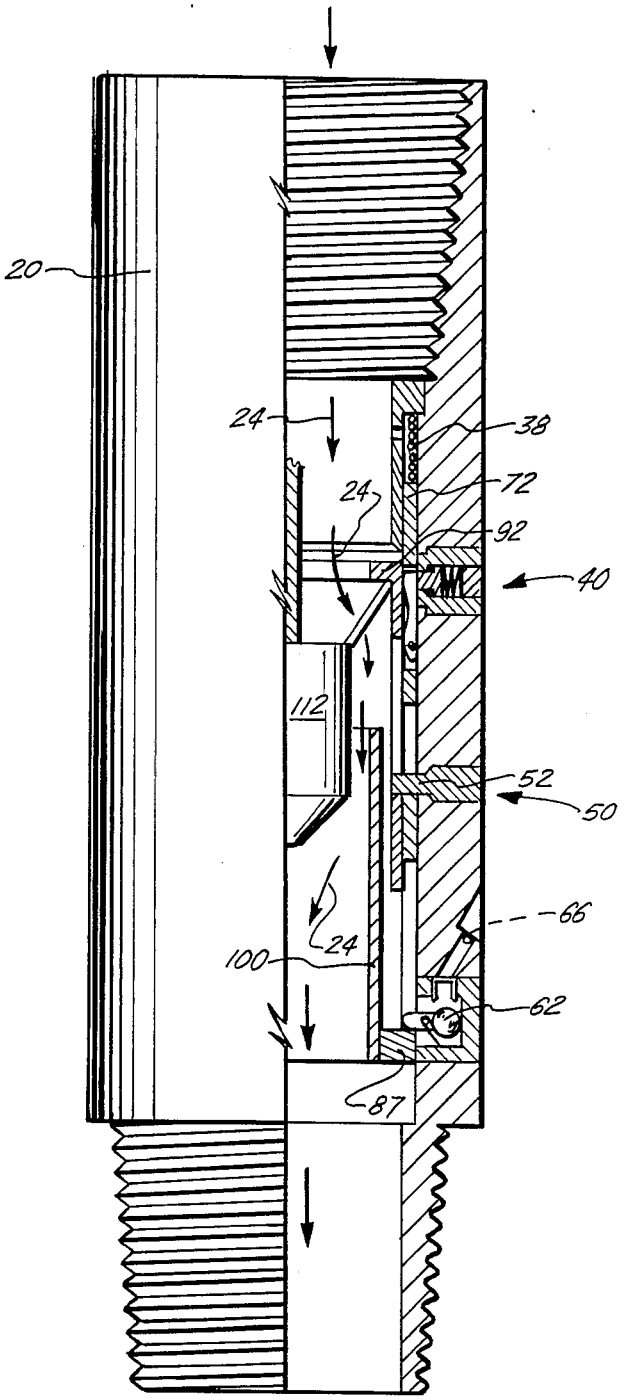
FIG. 4 is a one-quarter cutaway view of the preferred embodiment of the apparatus of the present invention in the unlocking position prior to being normally closed.
Figure 5:
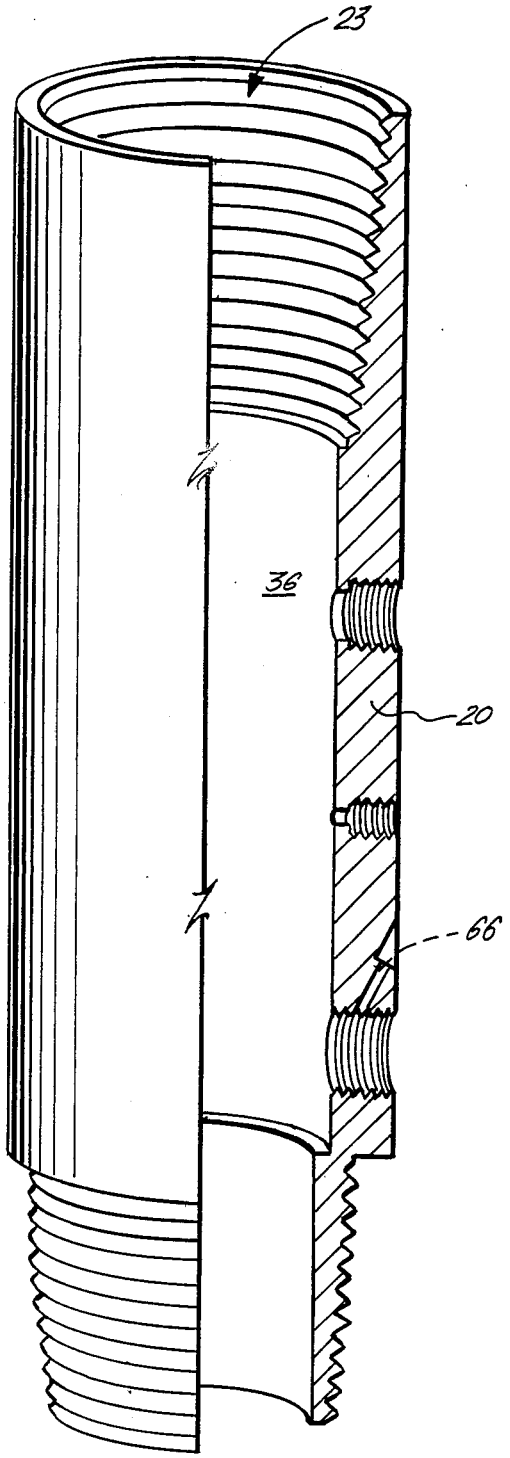
FIG. 5 is a one-quarter cutaway view of the main body portion of the preferred embodiment of the apparatus of the present invention.
Figure 7:
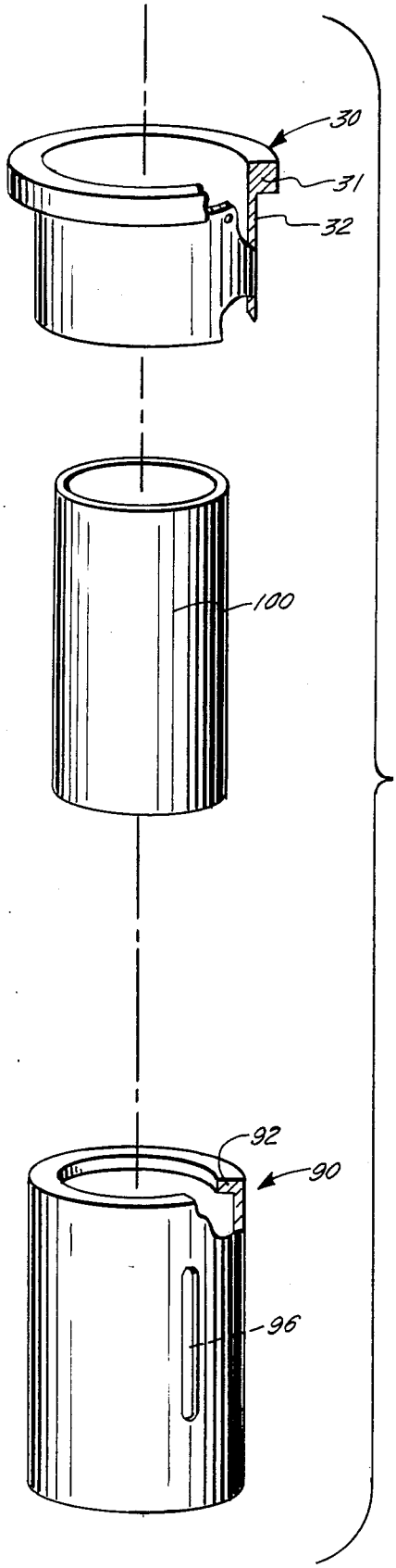
FIG. 7 is exploded view of the locking sleeve, retainer sleeve, and guard sleeve in the prefered embodiment of the apparatus of the present invention.
Figure 6:
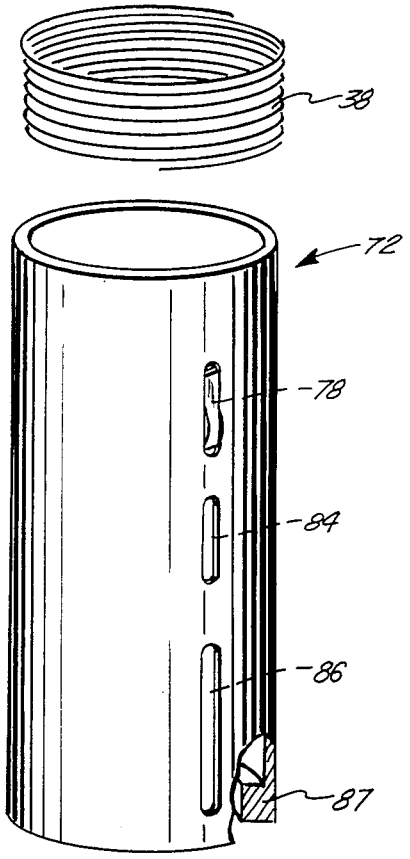
FIG. 6 is a overall view of the unlocking sleeve and coil spring in the preferred embodiment of the apparatus of the present invention.

At that point should the pipe become dislodged or the fluid flow is to be discontinued from fluid passage 66, reference is made to FIG. 4. Since main sleeve 72 is locked in the up position by detent pin 42, arm 114 of wireline 112 is moved passed guard sleeve 100 to make contact with shoulder portion 92 of unlocking sleeve 90. At that point, as seen in FIG. 4, wireline 112 has been moved slightly upward, and has likewise moved unlocking sleeve 90 from the position as seen in FIG. 2, i.e., the down position, to the position seen in FIG. 4. In doing so, unlocking sleeve 90 has made contact with arm member 80, which is adjacent the end portion 46 of detent pin 42, but in the line of passage of unlocking sleeve 90 as it moves upward. Therefore, unlocking sleeve 90 will force member 80 inward into the position as seen in FIG. 4, which will likewise push detent pin 42 to the position as seen in FIG. 4. At that point, main sleeve 72, under the bias of spring 38, is able to shift downward into the closed position as seen in FIG. 2. In doing so, ball valve 62 is no longer maintained in position via the lower collar 87 of main sleeve 72, and under the bias of flexing spring 70 will rotate back to the position as seen in FIG. 2 in sealing contact with valve seat 64, and therefore fluid will be blocked from flowing out of fluid flow passage 66. Therefore, the valve has moved from the closed position as seen in FIG. 2 to the open position as seen in FIG. 3, and returned to the closing position as seen in FIG. 4 with Fluid flow, as seen by arrows 24 in FIG. 4, resumed down-hole to the drill bit.

Figure 8A:
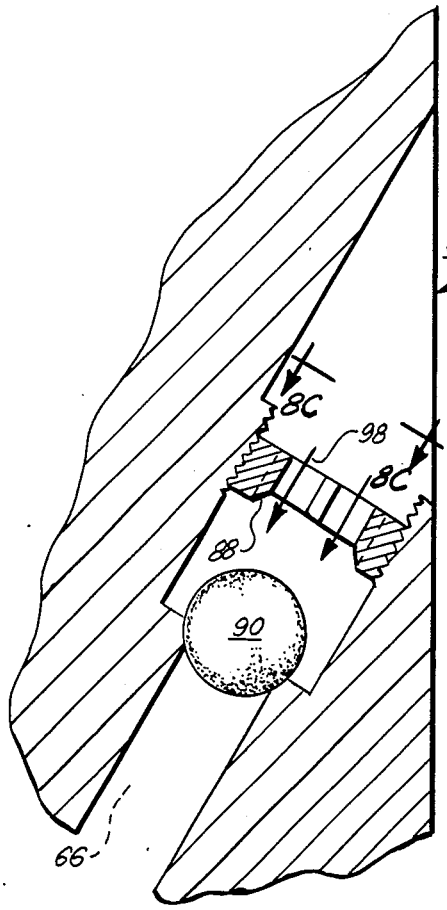
FIGS. 8*a*–8*c* are views of the check valve in the preferred embodiment of the present invention.
Figure 8C:
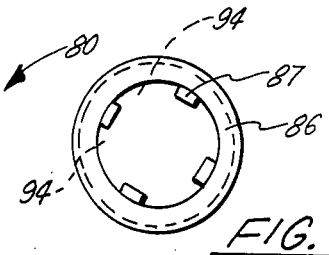
Figure 8B:
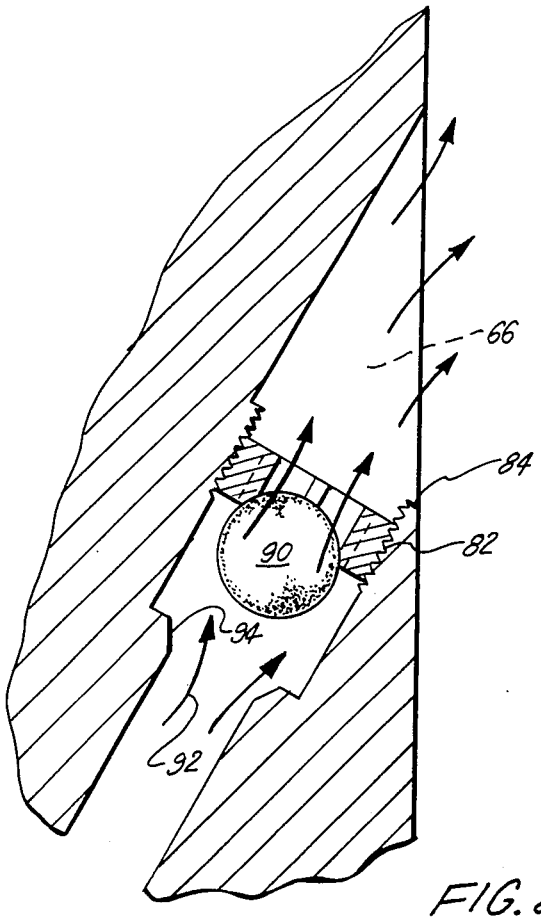

When the valve is in the open position in FIG. 3 and fluid flow is being directed or rechanneled through valve passage 66 to the exterior annular space 67, there will be formed therein a back pressure due to the confined space between valve 10 and wall 12 of the borehole 11. Therefore, fluid flow passage 66 will be provided with a valve means 80, as seen in FIGS. **8*a*–8*c*, valve means 80 comprising a oneway ball check valve 82 which generally includes a valve seat 84 fixed within passageway 66, through threading or the like. As seen in FIG. 8*c* valve seat 84 will comprise an annular seat body 86 having a plurality of valve seat members 87 which seatingly accommodate ball 90 against members 87 when fluid is flowing out of valve body 20 in the direction of arrows 92 as seen in FIG. 8*b*. Ball 90 although in seating engagement against seat members 87 is not in fluid sealing engagement, and fluid flow as seen by arrows 92 is able to flow around ball 90 through spaces 94 intermediate deep members 87 to exit port 69 to the surrounding media around valve apparatus 10. As was stated earlier, in the event back pressure occurs as seen in FIG. 8*a* as indicated by arrows 98, ball 90 would then shift to seal against sealing face 94, which is so designed to form a fluid seal between the surface of ball 90 and face 94 and disallow fluid flow through the restricted portion of passage 66. Therefore, it is insured through this structure that fluid flow will not be allowed to re-enter valve 20 despite the presents of back pressure within the surrounding media 67** in the bore hole.

Because many varying and different embodiments may be made within the scope of the invention concept herein taught, and because many modifications may be made in the embodiments herein detailed in accordance with the descriptive requirements of the law, it is to be understood that the details herein are to be interpreted as illustrative and not in a limited sense.

I claim:

1. A pipe recovery circulation valve apparatus for use in open hole well drilling to free a stuck drill string comprising a plurality of pipe sections having an internal pipe bore, comprising:

a. a series of valve bodies spaced longitudinally along the drill string, each having a continuous wall defining an internal longitudinal fluid flow bore with a transverse port therethrough;

b. valving means in the wall of each valve body shiftable from a first position blocking fluid flow at the port and from the internal bore out of the valve body to a second position for selectively allowing fluid flow to flow from the internal bore laterally out of the wall of the body through the transverse port;

c. an internal sleeve member movable within the bore between the first position, for engaging and shifting the valving means to the second position allowing a portion of the fluid in the internal bore to flow transversely in a generally lateral direction through the port out of the valve body yet allowing fluid flow in the internal bore to continue longitudinally through the valve; and d. means for maintaining the internal sleeve member in the second position so that fluid flow can continue through the wall of the valve body while simultaneous longitudinal flow continues through the longitudinal bore and the pipe bore.

2. The valve in claim 1, further comprising an unlocking sleeve member for releasing the internal sleeve member and allowing the internal sleeve member to shift from the second fluid flow position to the first blocking position.

3. The valve in claim 1, further comprising means within the wall of the valve body for disallowing fluid flow to the interior of the wall of the valve body from the surrounding media.

4. The valve in claim 1, wherein the means for selectively allowing fluid flow to flow out of the wall of the valve body further comprises a rotatable ball valve shiftable by the internal sleeve member between a position allowing fluid flow out of the wall of the body to a second position blocking fluid flow from the wall of the body.

5. The valve in claim 1, wherein the internal sleeve member is shiftable to the first position blocking fluid flow out of the valve body via a coil spring member.

6. The valve in claim 1, wherein the means for allowing the internal sleeve to shift from the position allowing to the fluid flow to the position blocking fluid flow out of the valve body further comprises an unlocking sleeve member moveable within the valve body.

7. The apparatus in claim 1, wherein the internal sleeve member is moveable to the second position allowing fluid flow out of the valve body by a wireline tool.

8. A pipe recovery circulation valve for use in open hole well drilling, located intermediate sections of drill pipe, comprising:

a. a valve body having a continuous wall defining a principal longitudinal fluid flow bore therethrough;

b. a fluid flow passage in the wall of the valve body allowing a portion of the fluid to flow through the fluid flow bore to the exterior of the valve body, yet allowing fluid to continue to flow through the principal flow bore;

c. a valve member selectively movable between a first position blocking fluid flow through the fluid flow passage and a second position allowing fluid flow through the flow passage;

d. a first main sleeve shiftable in the valve body for shifting the valve member into the second position;

e. detent means in the valve body, for maintaining the main sleeve in the first position;

f. a second unlocking sleeve adjacent the first main sleeve for causing shifting of the detent pin to a position that allows shifting of the main sleeve to the position wherein fluid flow is blocked from flowing through the fluid flow passage; and g. means communicating with the principal flow bore of the valve body for activating the shifting of the main sleeve.

* * * * *